United States Patent [19]

Miles et al.

[11] 4,025,056

[45] May 24, 1977

[54] MIXING APPARATUS

[75] Inventors: David Roy Miles; Alun Woolcock, both of Pontypool, England

[73] Assignee: Imperial Chemical Industries Limited, London, England

[22] Filed: June 30, 1975

[21] Appl. No.: 592,052

[30] Foreign Application Priority Data

July 15, 1974 United Kingdom ..... 31154/74

[52] U.S. Cl. ..... 259/6

[51] Int. Cl.[2] ..... B01F 7/16

[58] Field of Search ..... 259/6, 21, 41, 95; 418/191, 205, 206

[56] References Cited

UNITED STATES PATENTS

| | | | |
|---|---|---|---|
| 2,116,380 | 5/1938 | Bauer | 259/6 |
| 3,072,064 | 1/1963 | Burkholder | 418/191 |
| 3,179,383 | 4/1965 | Knedlik | 259/95 |
| 3,349,713 | 10/1967 | Fassbender | 259/6 |
| 3,734,468 | 5/1973 | Cheng et al. | 259/6 |
| 3,831,906 | 8/1974 | Wakeman | 418/206 |
| 3,869,224 | 3/1975 | Brinkman | 418/196 |

*Primary Examiner*—Richard E. Aegerter
*Assistant Examiner*—John W. Shepperd
*Attorney, Agent, or Firm*—Cushman, Darby & Cushman

[57] ABSTRACT

A gear pump comprising a driving and a driven gear, pairs of successive teeth of at least one gear each having a cut-out allowing a proportion of slip, the cut-outs each extending to the root of the tooth and the cut-outs in successive teeth being in axially differently located positions.

13 Claims, 7 Drawing Figures

FIG. 1.
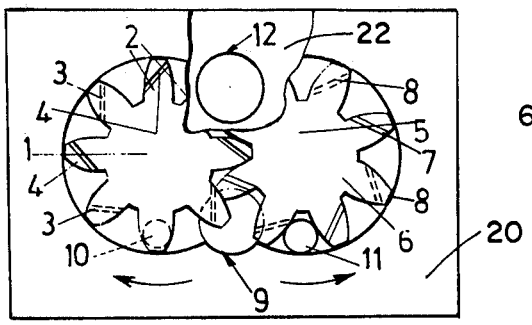
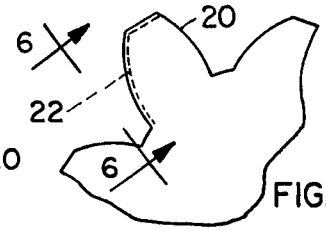
FIG. 5
FIG. 2.
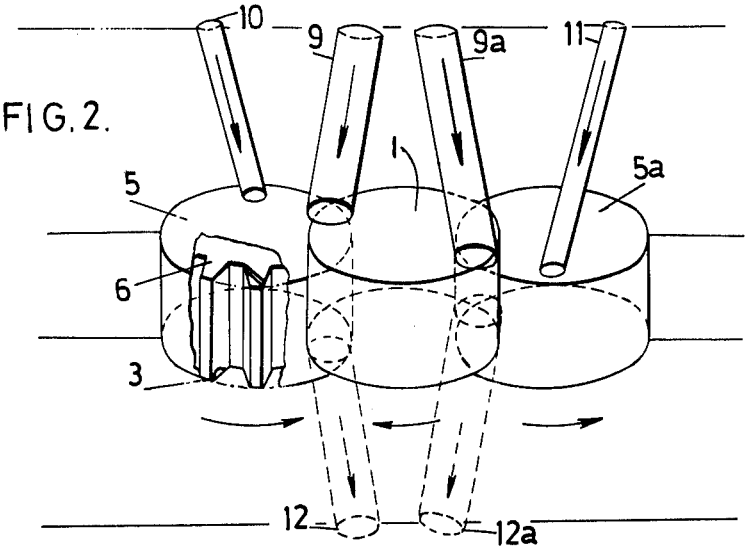
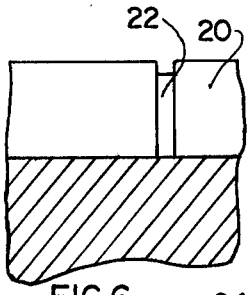
FIG. 6
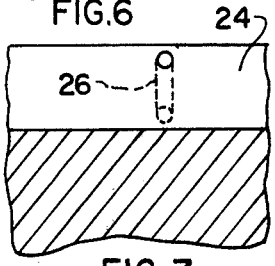
FIG. 7
FIG. 3.
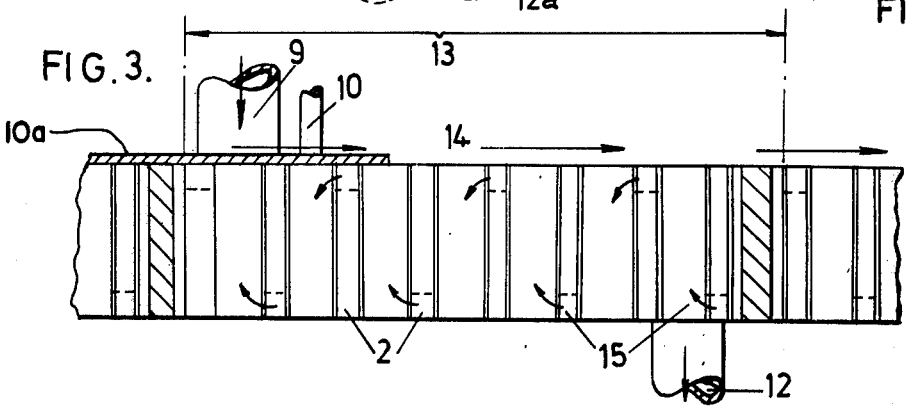
FIG. 4.
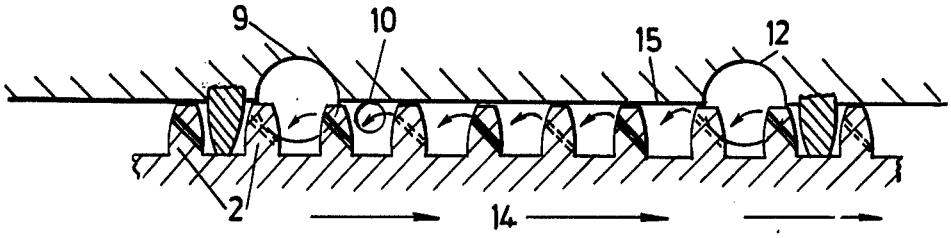

MIXING APPARATUS

The present invention relates to the mixing of liquids by passage through a gear pump.

U.K. Pat. Specification No. 1,138,390 described a process for preparing a stable uniform dispersion of an immiscible material in a liquid carrier comprising heating the immiscible material to a temperature between the temperature where the material becomes liquid and the temperature where the material begins to decompose and admixing the said immiscible material and liquid carrier by means of a gear pump.

U.K. Pat. Specification No. 1,106,322 describes a process for the continuous mixing and homogenising of liquids of different viscosities, wherein the liquid components are absorbed together in the required proportions from a pump the delivery rate of which per unit time is less than its nominal volume per unit time owing to a counterpressure, whereby there is superimposed upon one liquid stream a second liquid stream flowing in countercurrent thereto along a sinusoidal path.

We have found that, particularly in the case of highly viscous liquids, mixing even according to the description of U.K. Pat. No. 1,106,322 is inadequate, there being a tendency for liquid at the bottom of the trough between successive teeth to be inadequately mixed with the main bulk of the liquid.

According to the present invention a gear pump comprises a driving and a driven gear, pairs of successive teeth of at least one gear each having a cut-out allowing a proportion of slip, the cut-outs each extending to the root of a tooth and the cut-outs in successive teeth being in axially differently located positions.

Preferably the number of teeth in a gear having cut-outs is even and every tooth has a cut-out.

Preferably the axial distance between the cut-outs on successive teeth of a gear is maximised. Thus preferably there is only one cut-out in a tooth and the cut-out is close to one of the flat faces of the gear. Preferably the cut-out is formed in the flat face of the gear.

A cut-out comprises, for example, a channel cut in the crown of a tooth and extending to the root of the tooth, a duct passing from side to side of a tooth or a channel cut between the sides of a tooth on one of the flat faces of the gear. In general the cut-out should facilitate a flow between consecutive tooth gaps when the associated teeth are in proximity to the curved wall of the pump chamber. Preferably it should be arranged that there is no flow between consecutive tooth gaps when the associated teeth are at the position of meshing with the other gear.

Preferably the path for liquid through the cut-out should be blocked by an intermeshing tooth at the position of meshing.

According to our invention we also provide a process for the mixing of a liquid mass comprising pumping the liquid mass through a gear pump comprising a driving and a driven gear, pairs of successive teeth of at least one gear each having a cut-out allowing slip, the cut-outs each extending to the root of a tooth and the cut-outs in successive teeth being in axially different located positions whereby a flow in the axial direction is produced in the tooth gap between successive teeth each having a cut-out.

The cut-out should extend to the root of the tooth so that in operation of the pump, liquid located near the bottom of the tooth gap will form at least part of the slip flow. Preferably the cut-out should extend to the crest of the tooth so that liquid located throughout the depth of the tooth gap will form part of the slip flow.

By the word "slip" we mean a deliberately imposed degree of inefficiency in the operation of the pump. This degree of inefficiency results from the flow between consecutive tooth gaps through the cut-out. In general the degree of mixing of the liquid mass pumped through the pump will be greater the greater the degree of slip. Thus the flow between consecutive teeth will conveniently be arranged to ensure the desired degree of mixing. The flow in turn is controlled by the size and configuration of the cut-out, the pressure differential across the tooth and the effective viscosity of the liquid mass.

A gear pump according to the present invention may comprise more than two gears, for example three gears A, B and C, each of gears A and C meshing only with gear B and there being cut-outs in at least the teeth of gears A and C.

The gear pump according to the present invention is of particular advantage in mixing liquid masses which are highly viscous, examples of which are molten synthetic polymers for use in the fabrication of extruded articles, for example fibres, films and mouldings. Such liquid masses may be, for example, a polyamide a polyester or a polyolefine. Mixing may be effected by the use of the gear pump of a single liquid, for example to improve uniformity of temperature, or a minor proportion of a liquid or finely divided solid may thereby be dispersed or dissolved in a major amount of a liquid. Thus various adjuvants may be added to synthetic polymers which are to be extruded to form shaped articles, for example antistatic agents, antiflammability agents, compounds improving dyeability, delustrants, soluble or insoluble colours and stabilisers. Such adjuvants may be added together with a carrier liquid. In addition reactants may be added.

In the case particularly wherein an adjuvant in minor amount is being mixed with a main liquid, the adjuvant may be introduced into the pump at a feed point separate from the main feed point at which the main liquid enters. In such cases, advantageously the feed point for the adjuvant terminates at the inner surface of one of the flat side plates of the pump at a point swept at least in part by the teeth of at least one of the gears. Preferably the whole of the feed point for the adjuvant is swept by the teeth of one of the gears. Preferably the feed point for the adjuvant is located at the input side of the pair of gears, that is at a point where the pressure is relatively low. In the case wherein there are more than two meshing gears, an injection point may be associated with each pair of meshing gears. In such case, when the whole of each feed point is swept by the teeth of one of the gears it may advantageously be arranged that one feed point is fully free from obstruction by a tooth when the other is fully closed by a tooth, so that the pressure generated by the injectate pump is concentrated on each injection hole in turn.

In the case wherein a metered flow of mixed liquid mass is required, the gear pump according to the present invention may be used as a booster pump feeding a metering device, for example a metering gear pump. A plurality of such metering devices arranged in parallel may be fed by one booster pump.

Specific embodiments of the present invention will now be described with particular reference to FIGS. 1, 2, 3 and 4 wherein:

FIG. 1 shows a gear pump according to the present invention with one pair of gears.

FIG. 2 shows a gear pump according to the present invention with three gears, giving two pairs of meshing gears.

FIG. 3 shows the radial view of the development of the teeth of a driven gear of FIG. 2.

FIG. 4 shows the axial view of the development of the teeth of a gear of FIG. 1.

FIG. 5 is a fragmentary end view of a gear showing a second form of cut-out;

FIG. 6 is a partial sectional view taken on the line 6—6 of FIG. 5; and

FIG. 7 is a fragmentary front view of a gear showing a third form of cut-out.

Referring to FIG. 1, a driving gear (1) has eight teeth (2), alternate teeth (2) having at the one end cut-outs (3) in the form of channels cut into one of the flat faces of the gear (1) of width 1.5 mm and depth 4 mm and extending from close to the root at one side of a tooth (2) to close to the crest of a tooth (2) at the other side, and the remaining teeth (2) having cut-outs (4) at the other end, of similar size, shape and disposition. A driven gear (5) also has eight teeth (6) alternate teeth (6) hving slots (7) at the one end and slots (8) at the other end similar in shape and size to those described for the driving gear (1). The gears are arranged to operate within a pump chamber in conventional manner for a gear pump, the chamber comprising a first flat face, not shown, having a main inlet aperture (9) and minor inlet apertures (10) and (11), and a second flat face, not shown, having an outlet aperture (12).

FIG. 2 shows a pump with one driving gear (1) and two driven gears (5) and (5*a*). Two main inlet apertures (9) and (9*a*) are provided with two minor or secondary inlet apertures (10) and (11) in a first flat face side plate 10*a* (see FIG. 3) and two outlet apertures (12) and (12*a*) in a second flat face, not shown.

FIGS. 3 and 4 show the development of teeth (2) through one circumference as shown at (13). The direction of movement of the teeth is indicated by the arrows at (14) and the direction of slip (reverse flow) is indicated by the arrows at (15).

In operation, the major component, Nylon 6:6 polyamide in the molten state was fed to the inlet aperture (9) or apertures (9) and (9*a*). As adjuvant there was used the dystuff C.I. Solvent Red 52 dissolved in four times its weight of polyethylene neopentylene adipate as carrier. The proportion of adjuvant fed into the minor inlet apertures (10) and (11) jointly with relation to the major component was such as to give 1.0% of the dyestuff on the total of polyamide, carrier and dyestuff. Using the gear pump of FIG. 1 or FIG. 2, a good mixture of dyestuff and polyamide was obtained from the outlet (12) or the outlets (12) and (12*a*).

FIGS. 5 and 6 illustrate a gear tooth 20 in which the cut-out has the form of a channel 22 cut in the crown of the tooth and extending to the root.

FIG. 7 illustrates a gear tooth 24 in which the cutout is a duct or passage 26 cut between the front and rear sides of the tooth.

What we claim is:

1. In a gear pump having a housing forming a pump chamber having a curved wall and provided with at least one primary inlet port and at least one primary outlet port for the chamber, at least two intermeshing gears rotatably mounted in the chamber, each of said gears including teeth having front and rear sides and flat end faces and said gears cooperating with the curved wall of the chamber and with the ports to pump fluid from the inlet port to the outlet port, the improved construction which facilitates limited flow of fluid between consecutive tooth gaps when the associated teeth are in proximity to the curved wall of the pump chamber, said improved construction comprising an arrangement in which teeth of both gears have a passage extending from the root of the respective tooth on one side thereof toward the crest of that tooth the other side of that tooth for permitting said flow between consecutive tooth gaps, the passages in successive teeth being in axially different positions with respect to the axes of the gears.

2. A gear pump as in claim 1 in which the number of teeth in a gear having passage is even and every tooth has a passage.

3. A gear pump as in claim 1 wherein there is only one passage in each tooth having a passage and the passage is close to one of the flat faces of the gear.

4. A gear pump as in claim 1 wherein the passage comprises a duct passing from side to side of a tooth.

5. A gear pump as in claim 1 wherein the passage comprises a channel cut into the crown of a tooth and extending to the root of the tooth.

6. A gear pump as in claim 1 wherein the passage is formed in the flat face of the gear.

7. A gear pump as in claim 6 wherein the passage extends substantially to the crown of the tooth.

8. A gear pump according to claim 1 wherein the position and shape of the passage are such that flow through each passage is blocked by engagement of an intermeshing tooth with an end of the passage at the position of meshing.

9. A gear pump as in claim 1 wherein there are three gears one bearing no passages and intermeshing with each of two gears bearing passages.

10. A gear pump as in claim 1 wherein the pump housing includes a flat side plate adjacent the flat face of at least one of the gears, said plate having a secondary inlet port therein at a point swept at least in part by the teeth of at least one of the gears.

11. A gear pump as in claim 11 in which the secondary inlet port is entirely swept by the teeth of one of the gears.

12. A gear pump as in claim 11 wherein there are more than two intermeshing gears and wherein there is a secondary inlet port associated with each pair of meshing gears.

13. A gear pump as in claim 12 wherein each secondary inlet port is of such size and shape and so situated with respect to the gears that in operation one of the secondary ports is fully free from obstruction by a tooth when the other is fully closed by a tooth.

* * * * *